US009133837B2

(12) United States Patent
Anderson et al.

(10) Patent No.: US 9,133,837 B2
(45) Date of Patent: Sep. 15, 2015

(54) METHOD OF CONTROLLING A HYDRAULIC SYSTEM

(75) Inventors: Mark David Anderson, Oswego, IL (US); Michael Anthony Spielman, Jr., Brookfield, IL (US)

(73) Assignee: Caterpillar Inc., Peoria, IL (US)

( * ) Notice: Subject to any disclaimer, the term of this patent is extended or adjusted under 35 U.S.C. 154(b) by 2149 days.

(21) Appl. No.: 12/081,963

(22) Filed: Apr. 24, 2008

(65) Prior Publication Data

US 2009/0269213 A1 Oct. 29, 2009

(51) Int. Cl.
*F04B 49/00* (2006.01)

(52) U.S. Cl.
CPC ..... *F04B 49/002* (2013.01); *F04B 2201/0204* (2013.01); *F04B 2201/1201* (2013.01); *F04B 2201/1203* (2013.01); *F04B 2203/0208* (2013.01); *F04B 2203/0209* (2013.01)

(58) Field of Classification Search
CPC ..... F04B 2201/1201; F04B 2203/0209
USPC ..... 417/15, 34, 53, 212, 364
See application file for complete search history.

(56) References Cited

U.S. PATENT DOCUMENTS

| | | | | |
|---|---|---|---|---|
| 3,877,839 | A * | 4/1975 | Ifield | 417/217 |
| 3,975,909 | A | 8/1976 | McBurnett | |
| 4,335,577 | A | 6/1982 | Lobmeyer et al. | |
| 4,395,199 | A * | 7/1983 | Izumi et al. | 417/53 |
| 4,534,707 | A * | 8/1985 | Mitchell | 417/34 |
| 4,606,313 | A * | 8/1986 | Izumi et al. | 123/386 |
| 5,050,379 | A * | 9/1991 | Nagai et al. | 60/368 |
| 5,155,996 | A | 10/1992 | Tatsumi et al. | |
| 5,214,916 | A * | 6/1993 | Lukich | 60/431 |
| 5,295,353 | A * | 3/1994 | Ikari | 60/431 |
| 5,347,448 | A | 9/1994 | Nam | |
| 5,477,679 | A * | 12/1995 | Tatsumi et al. | 60/431 |
| 5,525,043 | A | 6/1996 | Lukich | |
| 5,576,962 | A * | 11/1996 | Ferguson et al. | 701/101 |
| 5,638,677 | A | 6/1997 | Hosono et al. | |
| 5,762,475 | A | 6/1998 | Maddock et al. | |
| 5,911,506 | A | 6/1999 | Nakamura et al. | |
| 5,934,879 | A * | 8/1999 | Konno et al. | 417/15 |
| 5,951,258 | A * | 9/1999 | Lueschow et al. | 417/22 |
| 5,967,757 | A | 10/1999 | Gunn et al. | |
| 6,010,309 | A * | 1/2000 | Takamura et al. | 417/22 |
| 6,021,756 | A * | 2/2000 | Nakamura | 123/385 |
| 6,119,786 | A | 9/2000 | Creger et al. | |
| 6,183,210 | B1 | 2/2001 | Nakamura | |
| 6,220,028 | B1 | 4/2001 | Ishikawa et al. | |
| 6,305,419 | B1 | 10/2001 | Krieger et al. | |

(Continued)

FOREIGN PATENT DOCUMENTS

| | | |
|---|---|---|
| EP | 0522171 | 1/1992 |
| EP | 0761491 | 3/1992 |

*Primary Examiner* — Devon Kramer
*Assistant Examiner* — Amene Bayou
(74) *Attorney, Agent, or Firm* — Finnegan, Henderson, Farabow, Garrett & Dunner, LLP

(57) ABSTRACT

A method of controlling a hydraulic system having a variable displacement pump operatively coupled to an engine. The method includes detecting a speed of the engine, and determining a desired power value of the pump. The method also includes identifying an allowable power value that may be expended by the pump at the detected speed. The method also includes selecting a pump power value. The selected pump power value is the lower of the allowable power value and the desired power value. The method further includes adjusting the pump to deliver the selected pump power value.

20 Claims, 4 Drawing Sheets

(56) References Cited

U.S. PATENT DOCUMENTS 6,666,023 B2 12/2003 Nagura et al.
6,986,368 B2 1/2006 Brown
7,165,397 B2 1/2007 Raszga et al.
2007/0137338 A1 6/2007 Nishi et al.

* cited by examiner

METHOD OF CONTROLLING A HYDRAULIC SYSTEM

TECHNICAL FIELD

The present disclosure relates generally to a system and a method of controlling a hydraulic system.

BACKGROUND

Construction machines having hydraulically controlled implements often include one or more variable displacement hydraulic pumps that are driven by an internal combustion engine. As the operator manipulates the implements through levers or other input devices in the operator cabin, the hydraulic system responds by directing hydraulic fluid flow to appropriate hydraulic circuits. To move an implement carrying a load in a desired direction at a desired velocity, the operator may operate one or more levers that direct flow of a hydraulic fluid, to apply force, and move the implement. As the operator requested hydraulic effort increases, the hydraulic control system increases the displacement of the variable displacement hydraulic pump such that the amount of hydraulic flow increases. Since the amount of power required to drive the hydraulic pump is a function of pressure and flow, as flow increases, a higher amount of engine power is expended to operate the implement. Load on the engine, is therefore, a function of hydraulic flow and pressure. Under some operating conditions, the amount of hydraulic power exceeds the amount of power the engine is capable of producing at that engine speed. When this occurs, the rotational speed of the engine decreases along its lug curve. This condition is typically referred to as engine lug.

When the engine lugs, operator perception of engine power may be adversely affected. In extreme cases, the engine may even stall if the requested hydraulic power becomes too high. To reduce lug and avoid stalling the engine, the operator may reduce the amount of hydraulic power being requested when they sense a loss of engine speed. While this action avoids engine stall, the operator may overcompensate and reduce the amount of hydraulic work to a greater extent than needed to prevent stall. As a result, machine productivity may be reduced. Fuel combustion in the engine during lug may become less efficient, resulting in increased emissions and reduced fuel economy. As a result, it may also be desirable to reduce engine lug to decrease emissions and fuel consumption. Some level of engine lug, however, may be desirable to operate the machine at maximum capacity. Therefore, the hydraulic system may be controlled to ensure that the machine is working at maximum capacity while limiting emissions and fuel consumption.

U.S. Pat. No. 5,525,043 ('043 patent), issued to Lukich on Jun. 11, 1996 and assigned to the assignee of the current disclosure, describes a hydraulic control system to reduce engine lug. In the control system of the '043 patent, multiple sensors are used to detect various operating parameters of the hydraulic system including the pump and an engine driving the pump. Based on these sensor inputs, a parameter signal that indicates the load on the engine is calculated. When the load on the engine increases above a predefined level, the displacement of the variable displacement pump is reduced to allow the engine speed to increase to the predefined level. In the control system of the '043 patent, the parameter signal is determined based on a number of operating parameters of the hydraulic system to accurately control engine speed with a minimum amount of oscillation (overshoot and undershoot). While quick and accurate control of engine speed by preventing oscillations, as disclosed in the '043 patent, may be important in some applications, it may not be as important in other applications. Although the control system of the '043 patent may effectively control engine lug, the complexity of the methodology employed may make the system expensive for some applications. The present disclosure is directed to solving one or more of the problems set forth above and/or other problems in the relevant art.

SUMMARY OF THE INVENTION

In one aspect, a method of controlling a hydraulic system having a variable displacement pump operatively coupled to an engine is disclosed. The method includes detecting a speed of the engine, and determining a desired power value of the pump. The method may also include identifying an allowable power value that may be expended by the pump at the detected speed. The method may also include selecting a pump power value. The selected pump power value may be the lower of the allowable power value and the desired power value. The method may further include adjusting the pump to deliver the selected pump power value.

In another aspect, a hydraulic system is disclosed. The hydraulic system includes an engine, and a variable displacement pump. The hydraulic power delivered by the pump may be a function of a piston displacement of the pump. The system may also include an implement fluidly coupled to the pump. The implement may be operable by the power delivered by the pump. The system may also include a sensor configured to measure engine speed, and a control system configured to identify an allowable power value that may be expended by the pump from a map that relates allowable power value to engine speed. The control system may also be configured to determine a desired power value. The desired power value may be a power value that is requested to operate the implement. The control system may be further configured to adjust the piston displacement to deliver a lower of the allowable power value and the desired power value to the implement.

In yet another aspect, a method of operating a machine having an engine and a hydraulically powered implement fluidly coupled to a pump is disclosed. The method includes detecting a signal indicative of a desired power value to operate the implement, and sensing a speed of the engine. The method may further include choosing an allowable power value that may be directed to the implement from a map that relates allowable power value to the sensed engine speed. The method may further include adjusting the pump to direct a lower of the allowable power value and the desired power value to the implement.

DETAILED DESCRIPTION

Figure 1:
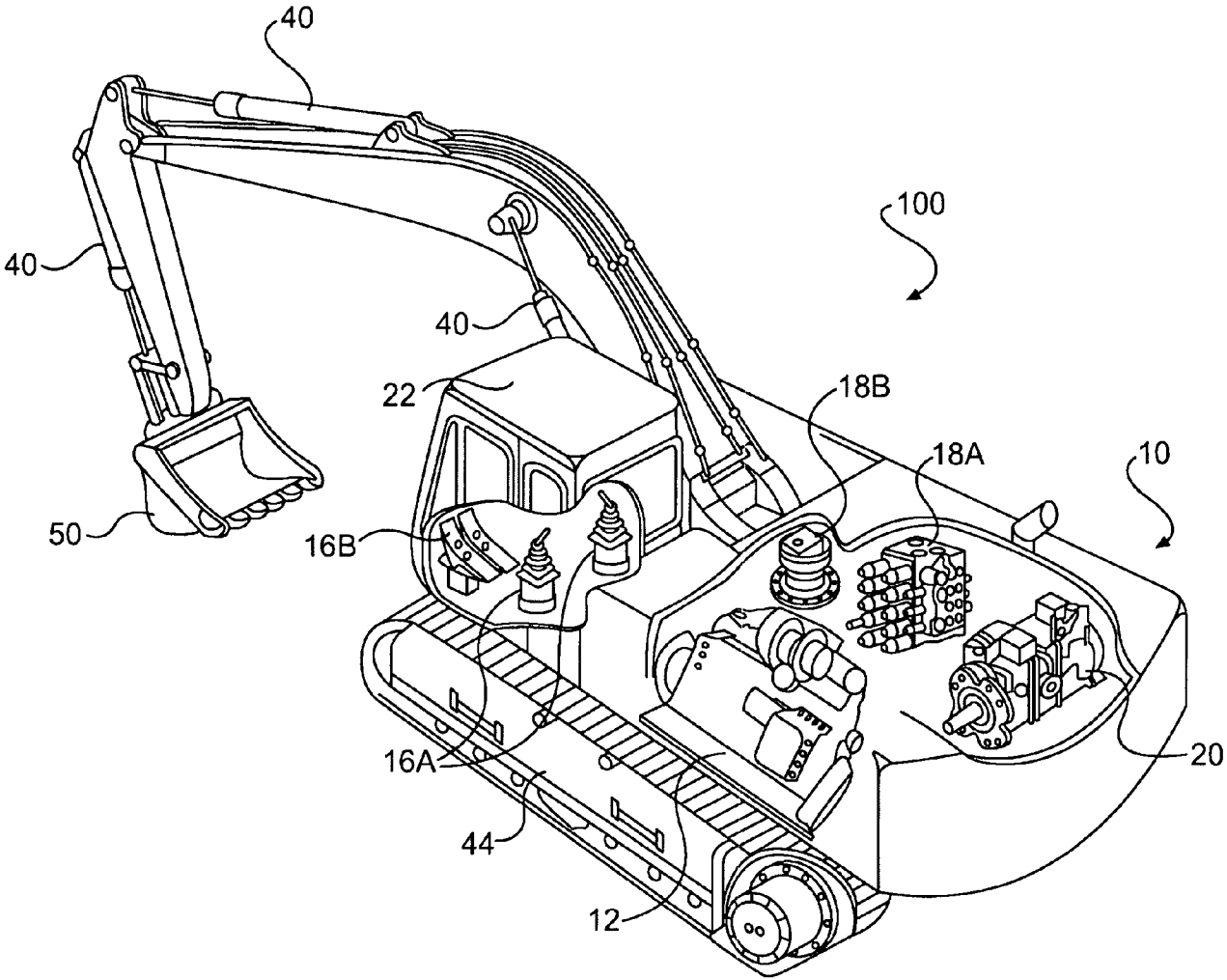
FIG. 1 is an illustration of an exemplary construction machine.

FIG. 1 illustrates an exemplary construction machine 100 having a hydraulic implement 50. Construction machine 100 may include any type of machine, such as an excavator. The hydraulic implement 50 may include any type of device that is operated by the force of a hydraulic fluid. Construction machine 100 may include a hydraulic system 10 that directs fluid under pressure to operate implement 50. One or more devices, such as hydraulic cylinders 40, coupled to construction machine 100, may assist in using the pressure of the hydraulic fluid to operate implement 50. An operator may operate implement 50 by controlling one or more levers 16A located in cab 22. Hydraulic system 10 may include one or more pumps 20 that direct the fluid to the hydraulic cylinders 40 in response to the operator's commands, and an internal combustion engine 12 that drives pump 20. Internal combustion engine 12 may be any type of engine known in the art. In some embodiments, in addition to driving pump 20, engine 12 may also drive other systems, such as a traction system 44, of machine 100. In these embodiments, the power output of engine 12 may be shared by pump 20 and traction system 44. Although, not discussed hereafter, hydraulic system 10 may also include devices, such as control valves 18A and safety devices 18B, that are typical in hydraulic systems known in the art.

Figure 2:
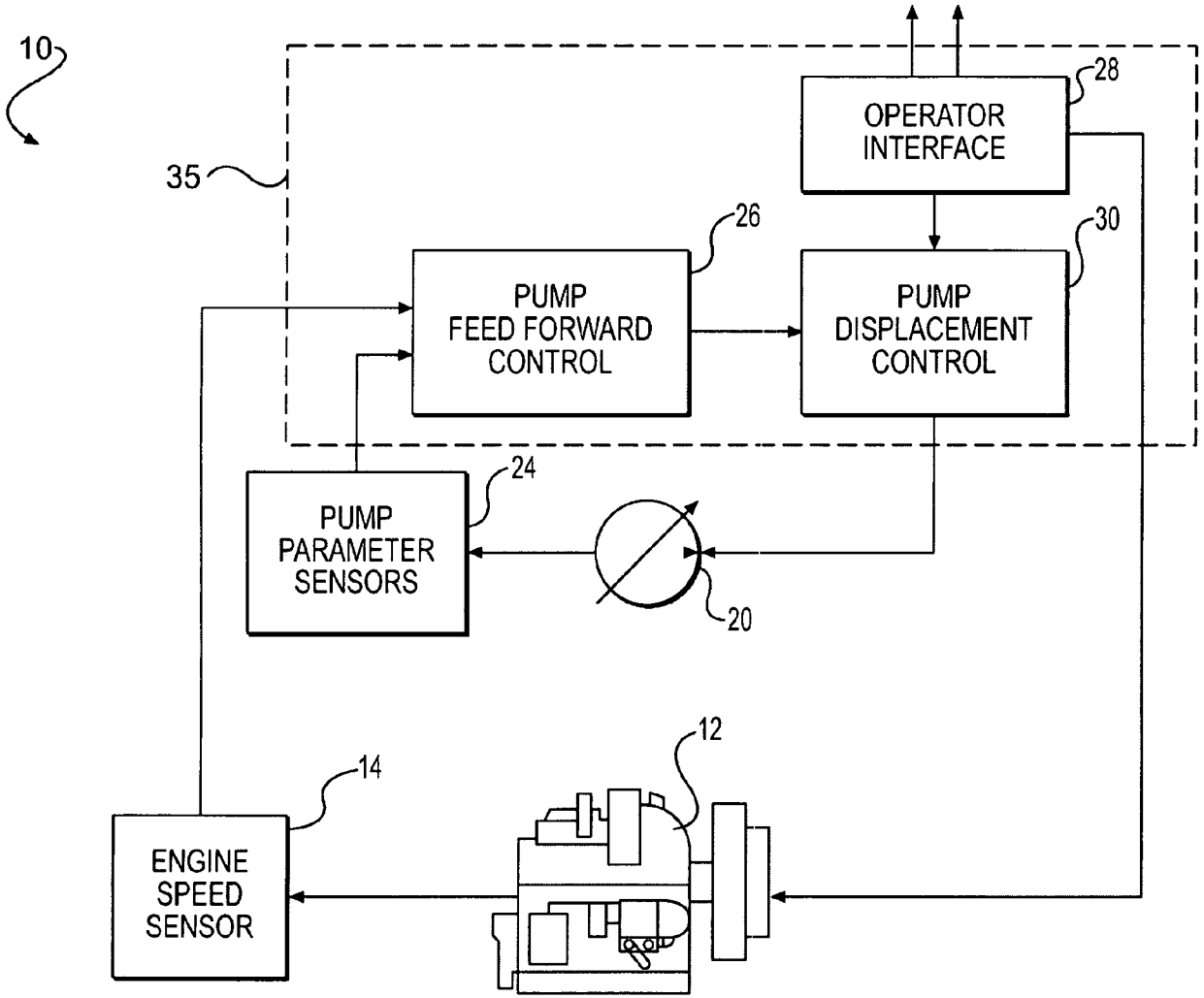
FIG. 2 is an exemplary hydraulic system of the construction machine of FIG. 1.

FIG. 2 is a schematic illustration of hydraulic system 10. For the sake of brevity, only those features of hydraulic system 10 that will be useful to describe the disclosed control method is illustrated in FIG. 2. An operator sitting in cab 22 may control the operation of machine 100. Part of the operator's control of machine 100 may include controlling levers 16A and pedals 16B. Signals in response to the operator's control of levers 16A and pedals 16B may be directed into an operator interface 28. For instance, operator may depress and release pedal 16B to change the speed of engine 12. A signal indicative of the position of pedal 16B may be input into operator interface 28. In response to this signal, operator interface 28 may change the speed of engine 12. Similarly, operator may control lever 16A to operate implement 50. A signal indicative of the lever position may also be input into operator interface 28. The lever position may indicate the amount of hydraulic power that the operator desires to be directed to implement 50. Based on this desired power, operator interface may determine the amount of flow that is to be directed to a particular hydraulic circuit to operate implement 50.

Engine 12 of hydraulic system 10 may function in response to operator input from operator interface 28. The operation of engine 12 is well known in the art, and therefore, will not be described herein. An engine speed sensor 14 may be operatively coupled to engine 12 to measure the speed of engine 12. Any type of speed sensor known in the art may be used as engine speed sensor 14. Engine 12 may be operatively coupled to pump 20 to drive an input shaft of the pump.

Pump 20 may be a variable displacement type of pump in which the stroke of the pistons (displacement) may be varied, while the pump is running. This piston displacement may correspond to the amount of fluid pumped per revolution of the input shaft. Since the cross-sectional area of the cylinders are a constant, as the stroke of the pistons increase, the amount of fluid pumped per revolution of the input shaft correspondingly increase. In some embodiments, pump 20 may have several pistons reciprocating in cylinders. A swashplate may be connected to the pistons at one end. The angle, or orientation, of the swashplate may determine the displacement of the pistons in the cylinders. A rotary valve, located at an end of the cylinder opposite the swashplate, may alternately connect each cylinder to fluid supply and delivery lines. By changing the angle of the swashplate, the displacement of the pistons may be varied continuously. Pump 20 may include mechanisms (such as, mechanical links or electronic devices) that enable the swashplate angle to be changed in response to commands from a control system 35.

Pump parameter sensors 24 may be coupled to pump 20 to measure operating parameters of pump 20. In this disclosure, pump parameter sensors 24 are used to collectively refer to all sensors that measure operating parameters of pump 20. These sensors may include sensors that measure the discharge pressure ($P_d$) of pump. Discharge pressure ($P_d$) is the pressure of the fluid that exits pump 20. In some embodiments, pump parameter sensors 24 may also include sensors that indicate the current displacement ($d_{current}$) of pump 20. Current displacement of pump 20 may be determined by the position of the swashplate of pump 20.

Input from engine speed sensor 14 and pump parameter sensors 24 may be directed to a pump feed forward control 26. Based on these sensor inputs, pump feed forward control 26 may determine an allowable torque $T_{allowable}$ that may be expended to operate implement 50. Pump feed forward control 26 may send a signal indicative of the allowable torque and data measured by pump parameter sensors 24 to a pump displacement control 30. Based on the determined $T_{allowable}$, pump displacement control 30 may determine the allowable displacement ($d_{allowable}$) of pump 20. Operator input from operator interface 28 may also indicate a desired displacement ($d_{desired}$) of pump 20. The desired displacement may be a function of the operator requested hydraulic effort to operate implement 50. Based on the determined allowable displacement $d_{allowable}$ and operator desired displacement $d_{desired}$, pump displacement control 30 may set the displacement of pump 20.

Operator interface 28, pump feed forward control 26, and pump displacement control 30 may be hardware of software modules of control system 35 of machine 100. In some embodiments, one or more of these modules may be combined together. Control system 35 may be a standalone part or may be part of a larger electronic control unit of machine 100. Control system 35 may include memory and computational devices as is common in control systems known in the art. The memory devices may store maps and other specifications of the hydraulic system 10.

Figure 3:
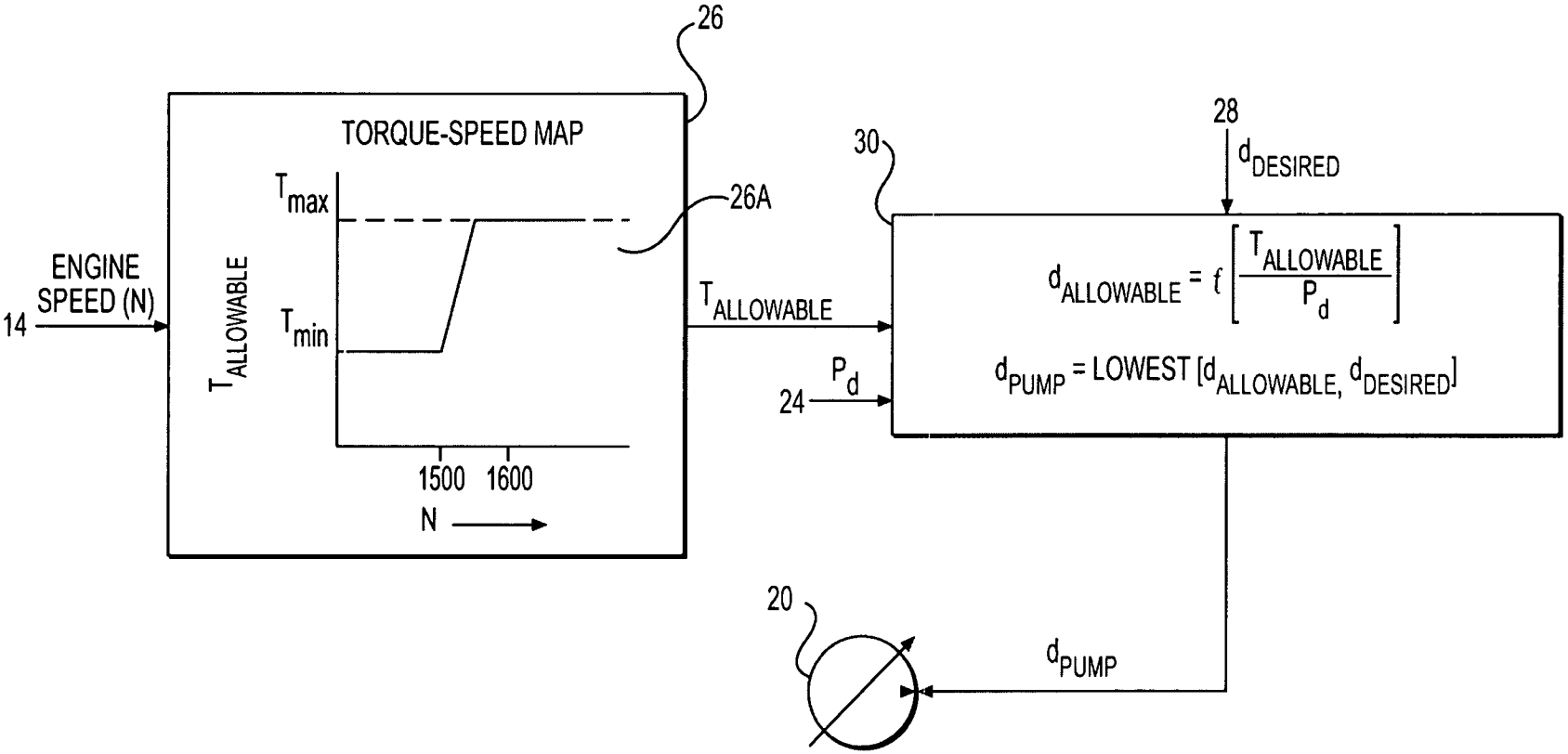
FIG. 3 is a schematic illustration of an algorithm used by the hydraulic system of FIG. 2.

FIG. 3 illustrates a schematic of a control algorithm used in hydraulic system 10. The maximum torque that may be expended by pump 20 to operate implement 50, $T_{allowable}$, may be determined by pump feed forward control 26 based on a map 26A. Map 26A may be stored in control system 35 or may be calculated based on stored and measured values. Map 26A may specify $T_{allowable}$ at a measured value of engine speed N. The shape of map 26A may depend upon the application. In general, $T_{allowable}$ may vary from a maximum torque $T_{max}$ to a minimum torque value $T_{min}$. At high engine speeds, $T_{allowable}$ may be set to $T_{max}$, and at low engine speeds, $T_{allowable}$ may be set to $T_{min}$. In the exemplary map 26A depicted in FIG. 3, at engine speeds below 1500 rpm, $T_{allowable}$ may be set to $T_{min}$, and at engine speeds above about 1550 rpm, $T_{allowable}$ may be set to $T_{max}$. The absolute values of $T_{max}$ and $T_{min}$ may also depend upon the application. In some embodiments, $T_{max}$ may be the maximum rated torque of pump, and $T_{min}$ may be a fraction of the $T_{max}$ value (such as, for example 50% of $T_{max}$). The maximum rated torque of pump may be a value specified by the manufacturer or determined from the specifications of pump 20. For instance, in cases where the maximum permissible displacement (or the maximum discharge volume) and maximum discharge pressure $P_d$ of pump 20 are specified, $T_{max}$ may be obtained as a function of the product of the maximum discharge pressure and the maximum permissible displacement (that is, $T_{max}$=Max discharge volume×maximum discharge pressure)

of pump 20. In some embodiments, map 26A may specify $T_{allowable}$ as a percentage of $T_{max}$. $T_{allowable}$ determined from map 26A may be input to pump displacement control 26.

Pump parameter values, such as $P_d$ and $d_{current}$, may also be directed to pump displacement control 30. In some embodiments, $d_{current}$ may not be measured by pump parameter sensor 24. In these embodiments, $d_{current}$ may be value of the most recent pump displacement value $d_{pump}$ input to pump 20. Based on $T_{allowable}$ and $P_d$, pump displacement control 30 may determine the allowable displacement $d_{allowable}$ of pump 20. In some embodiments, $d_{allowable}$ may be determined as a function of $T_{allowable}/P_d$. Pump displacement control 30 may compare the allowable pump displacement $d_{allowable}$ value to the desired pump displacement $d_{desired}$, input from operator interface 28. As mentioned earlier, $d_{desired}$ may be determined by operator interface 28 based on the position of lever 16A. Pump displacement control 30 may then set pump displacement $d_{pump}$ to be the lower of $d_{allowable}$ and $d_{desired}$. Pump displacement value $d_{pump}$ may then be input into pump 20 to change the location of the pump swashplate. If the desired pump displacement value is lower than the allowable value (that is, $d_{desired}<d_{allowable}$), the displacement of the pump may be set to the desired value. In this case, the operator power demand may be completely satisfied. However, if $d_{desired}$ is greater than $d_{allowable}$ ($d_{desired}>d_{allowable}$) then the pump displacement may be set to the maximum allowable value. In this case, the operator's power demand may not be completely satisfied, and only the maximum allowable power at the current engine speed may be delivered to implement 50. In some embodiments, pump displacement control 30 may also compare the computed pump displacement value $d_{pump}$ to the current pump displacement value $d_{current}$, and not change the pump displacement if $d_{pump}$ is within a predetermined range of $d_{current}$.

Engine speed sensor 14 and pump parameter sensors 24 may continue to monitor the operating parameters of hydraulic system 10, and change $d_{pump}$ in response to changes in engine speed and desired pump displacement $d_{desired}$. Although the description above describes the pump displacement value as being selected based on a comparison between a desired and allowable pump displacement, it is contemplated that any variable that is indicative of pump power (pump displacement, torque, flow, etc.) may be used for the comparison. That is, in some embodiments, torque expended by pump may be determined based on a comparison of allowable torque to a desired torque, while in some other embodiments, flow delivered by pump may be determined based on an allowable flow to a desired flow. Therefore, in this disclosure, the term power value is used to represent any parameter (such as, for example, pump displacement, torque, flow, etc.) that is indicative of pump power.

INDUSTRIAL APPLICABILITY

The disclosed embodiments relate to a system and a method of controlling a hydraulic system. The hydraulic control system may be used to limit the power used by a pump to below a desired value when the speed of the engine decreases below a prescribed limit. By limiting the power used by the pump, further reduction in engine speed and engine lug may be avoided. By limiting the pump power only when it is truly needed and only to the extent that is needed to prevent lug, machine performance and operator perception of machine power may be enhanced. To illustrate the application of the disclosed hydraulic control system, an exemplary embodiment will now be described.

Pump 20, rated to produce a maximum pressure of $P_{max}$ and a maximum displacement of $d_{max}$ may be fluidly coupled to a hydraulic cylinder 40 that operates implement 50 of construction machine 100. Pump 20 may be operatively coupled with an engine 12 that also drives a propulsion system 44 of machine 100. An operator may control machine 100 by operating levers 16A and pedals 16B located in cab 22 of machine 100. During a construction task, such as lifting a load using implement 50, operator may control lever 16A to increase the hydraulic power directed to implement 50. The speed of engine 12 at this time may depend on the loads (such as the torque used by the propulsion system 44) on engine 12 and the position of lever 16B. Based on the measured operating parameters of machine 100, hydraulic system 10 may determine the amount of power that may be directed to implement 50.

Figure 4:
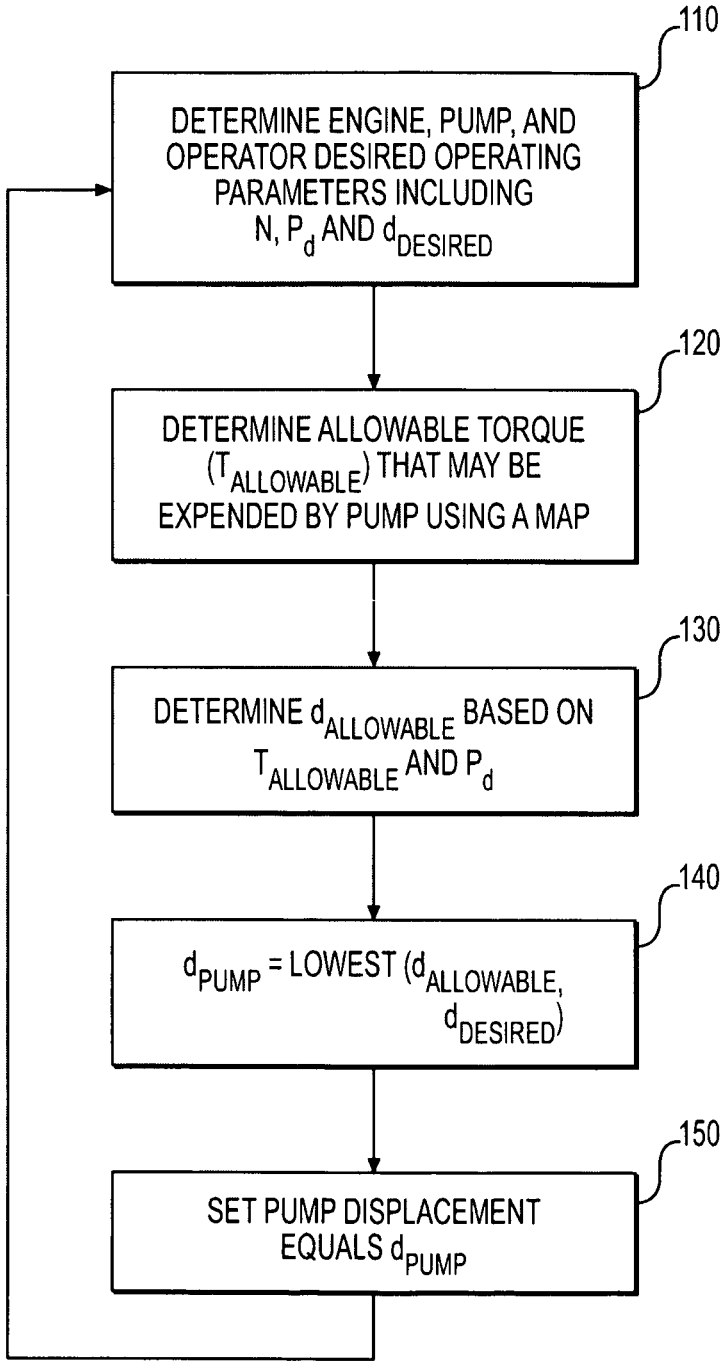
FIG. 4 is a flow chart that illustrates the functioning of the hydraulic system of FIG. 2.

FIG. 4 illustrates the steps used by hydraulic system 10 to determine the amount of power directed to implement 50. Current operating parameters, such as engine speed N and pump discharge pressure $P_d$, and desired operating conditions, such as $d_{desired}$, are collected (step 110). The allowable torque ($T_{allowable}$) that may be directed to pump 20 at the measured engine speed N may be read off map 26A (step 120). The pump displacement corresponding to the determined $T_{allowable}$ (that is, $d_{allowable}$) may be calculated as $d_{allowable}=f(T_{allowable}/P_d)$ (step 130). This allowable displacement ($d_{allowable}$) may be compared with the operator desired pump displacement ($d_{desired}$), and the lower of these displacement values may be used to set the displacement ($d_{pump}$) of pump 20 (steps 140 and 150). The operating parameters of hydraulic system 10 may be continuously monitored and $d_{pump}$ updated when conditions change.

When the engine speed is high, the hydraulic system may not limit the amount of torque that may be used to operate the implement. When the load on the engine is high, engine speed decreases, and the system may limit the allowable power that may be used to operate the implement. At these conditions, the allowable power may be limited to an such an extent that the engine operates at maximum capacity. Limiting the power used by the implement at low engine speed, may allow the engine to operate at maximum capacity without causing the engine to lug. Determining the allowable torque used by the implement using a minimal number of operating parameters of the hydraulic system reduces system complexity and cost.

It will be apparent to those skilled in the art that various modifications and variations can be made to the disclosed system and method of controlling a hydraulic system. Other embodiments will be apparent to those skilled in the art from consideration of the specification and practice of the disclosed system and method of controlling a hydraulic system. It is intended that the specification and examples be considered as exemplary only, with a true scope being indicated by the following claims and their equivalents.

We claim:

1. A method of controlling a hydraulic system having a variable displacement pump operatively coupled to an engine, comprising:

detecting a speed of the engine;

determining a desired power value of the pump based on user input;

identifying an allowable power value that may be expended by the pump based on a map that indicates the allowable power value at the detected speed;

selecting a pump power value, the selected pump power value being the lower of the allowable power value and the desired power value; and adjusting the pump to deliver the selected pump power value.

2. The method of claim 1, wherein the map indicates an allowable power value at a lower engine speed to be less than or equal to an allowable power value at a higher engine speed.

3. The method of claim 1, wherein the allowable power value is a function of a maximum rated power of the pump.

4. The method of claim 1, wherein determining a desired power value includes determining a desired displacement of the pump, the desired displacement being a value of pump displacement that will deliver a power value approximately equal to the desired power value.

5. The method of claim 4, wherein identifying an allowable power value includes determining an allowable displacement of the pump, the allowable displacement being a value of pump displacement that will deliver a power value approximately equal to the allowable power value.

6. The method of claim 5, further including detecting a discharge pressure of the pump and wherein determining the allowable displacement includes calculating the allowable displacement as a function of the allowable power value divided by the detected discharge pressure.

7. The method of claim 5, wherein selecting a pump power value includes selecting a pump displacement, the selected pump displacement being the lower of the desired displacement and the allowable displacement.

8. The method of claim 7, wherein adjusting the pump includes setting a displacement of the variable displacement pump to be equal to the selected pump displacement.

9. The method of claim 1, wherein the hydraulic system further includes an implement operable by a fluid discharged by the pump, and adjusting the pump includes adjusting the pump to deliver the selected pump power value to the implement.

10. The method of claim 1, further including readjusting the pump to deliver a new selected pump power value in response to a change in speed or desired power value.

11. A hydraulic system, comprising:

an engine;

a variable displacement pump, wherein a hydraulic power delivered by the pump is a function of a piston displacement of the pump;

an implement fluidly coupled to the pump, the implement being operable by the power delivered by the pump;

a sensor configured to measure engine speed; and a control system configured to identify an allowable power value that may be expended by the pump from a map that relates allowable power value to engine speed, the control system also being configured to determine a desired power value, the desired power value being a power value that is requested to operate the implement, the control system further being configured to adjust the piston displacement to deliver a lower of the allowable power value and the desired power value to the implement.

12. The hydraulic system of claim 11, wherein the hydraulic system is a part of a machine.

13. The hydraulic system of claim 11, further including a lever configured to direct a signal indicative of the desired power value to the control system.

14. The hydraulic system of claim 11, further including readjusting the pump to deliver a new selected pump power value in response to a change in speed or desired power value.

15. A method of operating a machine having an engine and a hydraulically powered implement fluidly coupled to a pump, comprising:

detecting a user input signal indicative of a desired power value to operate the implement;

sensing a speed of the engine;

choosing an allowable power value that may be directed to the implement from a map that relates allowable power value to the sensed engine speed; and adjusting the pump to direct a lower of the allowable power value and the desired power value to the implement.

16. The hydraulic system of claim 15, wherein detecting the user input signal includes detecting signals generated as a result of activation of a lever by the user.

17. The method of claim 15, wherein the pump is a variable displacement pump and adjusting the pump includes adjusting a displacement of the pump.

18. The method of claim 17, wherein detecting a signal indicative of the desired power value includes detecting a desired pump displacement that will generate the desired power value, and choosing an allowable power value further includes calculating an allowable pump displacement that will generate the allowable power value.

19. The method of claim 18, wherein adjusting the pump includes adjusting a displacement of the pump to be a lower of the desired pump displacement and the allowable pump displacement.

20. The method of claim 18, further including detecting a discharge pressure of the pump, and wherein calculating the allowable pump displacement includes calculating the allowable pump displacement as a function of the allowable power value divided by the discharge pressure.

* * * * *